US006792873B1

(12) United States Patent
Gnezdilov

(10) Patent No.: US 6,792,873 B1
(45) Date of Patent: Sep. 21, 2004

(54) BIG DIPPER

(76) Inventor: Vladimir A. Gnezdilov, Moldavskaya 8, apt 81, Moscow 121467 (RU)

( * ) Notice: Subject to any disclaimer, the term of this patent is extended or adjusted under 35 U.S.C. 154(b) by 0 days.

(21) Appl. No.: 10/240,283

(22) PCT Filed: Nov. 14, 2000

(86) PCT No.: PCT/RU00/00466

§ 371 (c)(1),
(2), (4) Date: Sep. 30, 2002

(87) PCT Pub. No.: WO02/40121

PCT Pub. Date: May 23, 2002

(51) Int. Cl.[7] ..... A63G 1/00
(52) U.S. Cl. ..... 104/53
(58) Field of Search ..... 104/53, 55, 56, 104/63

(56) References Cited

U.S. PATENT DOCUMENTS

| | | | | | |
|---|---|---|---|---|---|
| 3,889,605 | A | * | 6/1975 | Bacon | 104/56 |
| 4,165,695 | A | * | 8/1979 | Schwarzkopf | 104/55 |
| 4,724,771 | A | * | 2/1988 | Yamada | 104/56 |
| 5,433,153 | A | * | 7/1995 | Yamada | 104/63 |

* cited by examiner

*Primary Examiner*—S. Joseph Morano
*Assistant Examiner*—Robert J. McCarry, Jr.
(74) *Attorney, Agent, or Firm*—I. Zborovsky

(57) ABSTRACT

The invention relates to the entertainment industry. The inventive big dipper comprises a base (1), a closed guidway provided with a spiral part (3) for lifting, a part (4) arranged in the station (5) area, a dead loop part (6) and a transport means. Said transport means turns about the longitudinal axis of the spiral part (3) for lifting until a roll-over is performed prior to landing. Said invention provides passengers with a variety of entertaining effects.

8 Claims, 1 Drawing Sheet

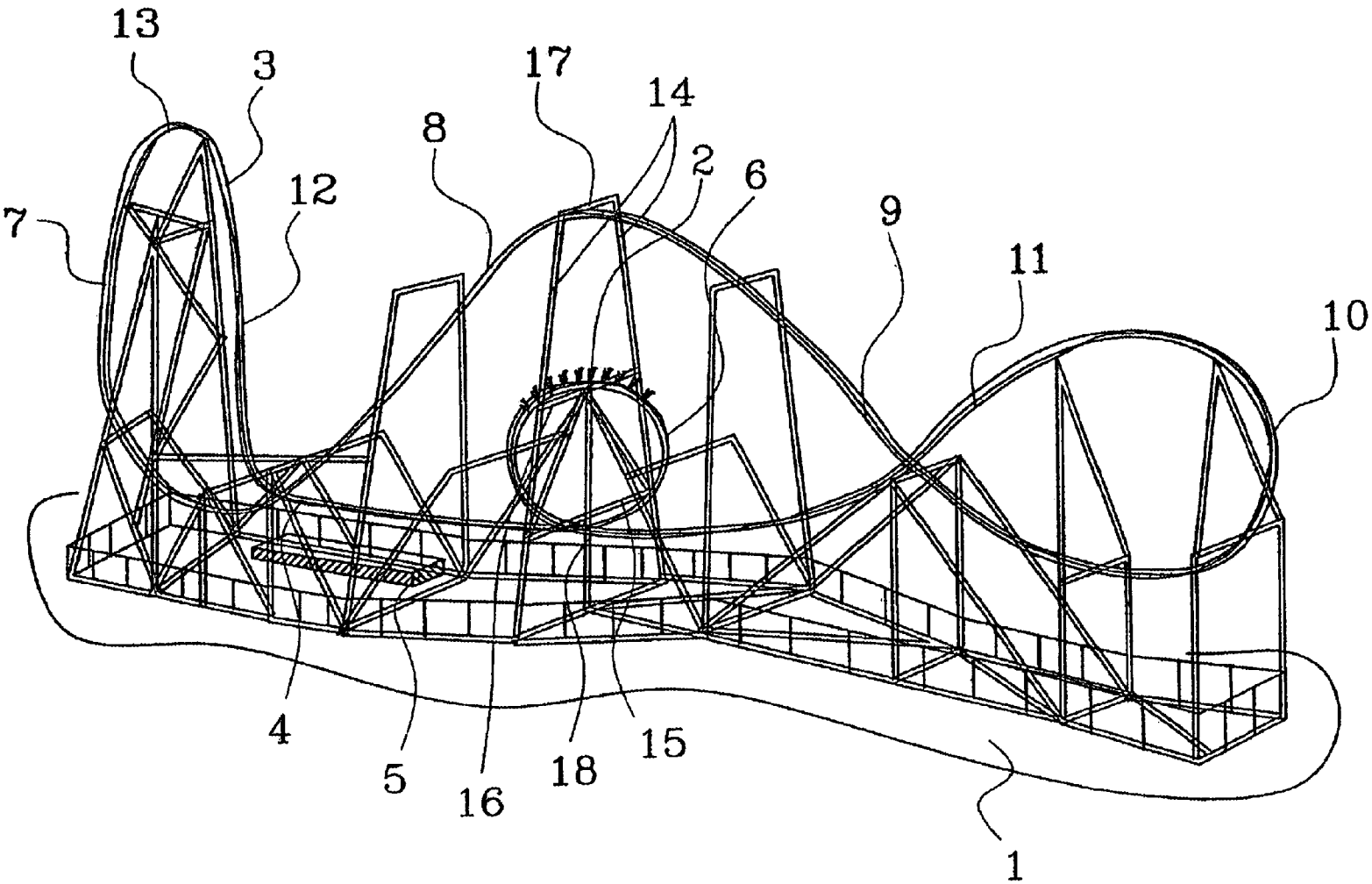
10
11
9
6
2
14
17
8
12
3
13
7
1
15
18
16
5
4

BIG DIPPER

FIELD OF INVENTION

The invention pertains to the amusement industry.

PREVIOUS ART

At the moment a great number of roller coasters are known, including those with spiral track sections (see the GAMES & PARKS INDUSTRY magazine, No 6, June, 1998, p. 94)

A drawback of all known roller coaster type amusement rides is the uniformity of the initial sections of the closed guide circuit, which causes monotony of the obtained thrill effects.

OBJECT OF THE INVENTION

The engineering result, which constitutes the object of the invention, consists in providing a variety of thrills at the very start of the vehicle motion.

The indicated result is achieved due to the fact that in a roller coaster comprising a closed guide circuit, a station, and a vehicle, the guide circuit is produced with a spiral ascent section which is associated with a section located in the station area and with which a looping section might be associated.

In the preferred version of the roller coaster the closed guide circuit comprises the consecutively connected between the spiral ascent section and the <<looping>> section a descent section, a second ascent section, a second descent section, a loop with an ascent section and a spiral descent section, the <<looping>> section being positioned under the upper portions of the second ascent and descent sections, the conjugation sections of which as well as the portions of the <<looping >> section are linked to the respective cross-pieces whose ends are tied to two supports, the initial and final parts of the <<looping>> section being fastened on one of the cross-pieces.

To enhance the structural rigidity, the middle parts of the cross-pieces linked to the portions of he <<looping >> section are connected with the vertical support.

To increase the provided range of thrills, the middle part of the spiral ascent section may deflect from the vertical line (inclined in the station direction or in any other direction), and the vehicle or its part is located on its end portion before the ascent in the displaced position, i.e., in the course of the motion the vehicle performs a turning by 180°, 540°, 900°, etc., depending on the ascent section length.

To make the loading and unloading of passengers more comfortable the section located in the station area can be displaced along the vertical line, one being able to use vehicles both bearing against the guide circuit and suspended on it.

BRIEF DESCRIPTION OF THE DRAWINGS

The essence of the invention is explained by means of a drawing depicting a roller coaster.

VERSIONS OF THE INVENTION IMPLEMENTATION

Roller coaster comprises base 1, vehicle 2, closed guide path including spiral ascent section 3, section 4 located within station area 5, <<looping>> section 6, descent section 7, a second ascent section 8, a second descent section 9, loop with ascent section 10 and spiral descent section 11.

Middle part 12 of ascent section 3 is inclined backwards (in the station direction), and the section is produced in such a way that part of vehicle 2 could be positioned on its end part 13 in the reverse position, i.e., passengers are upside down in the upper area.

Section 4 of the guide path, located in the station area for the convenience of the passengers loading and unloading, can be produced in such a way that it can be displaced vertically and joined to sections 3 and 6.

To fasten and shape sections 6, 8, 9, one uses two supports 14 connected to the ends of cross-pieces 15, 16, 17, which are respectively linked to parts of section 6 and the section for conjugating sections 8 and 9.

Cross-piece 15 is linked to the initial and final parts of <<looping>> section 6, and cross-piece 16—to its upper part. Cross-pieces 15, 16 are linked to the base of vertical support 18.

Such a design of the power links enables one to simplify the roller coaster structure and to reduce costs of its manufacture and assembly.

The amusement ride per the invention functions in a manner similar to that of known roller coasters, its distinctive feature being the creation of thrills on all sections of the closed guide path.

Section 3 of the guide path in the area of station 4 is a part of the hoist provided for the convenience of the passengers loading and unloading.

On ascent section 2 the vehicle moves along a spiral (a helical line) and a maximum thrill is achieved, which is enhanced due to a free-fall simulation on descent section 9, whose distinctive feature is its suddenness since the passengers using a suspended vehicle are positioned upside down and cannot see the descent section and so experience a free-fall simulation on descent section 9.

Industrial Applicability

The amusement ride increases the range of thrills by conjugating different ascent sections, operational convenience and ease being provided.

The power links design makes it possible to simplify the roller coaster structure and reduce the costs of its manufacture and assembly.

What is claimed is:

1. A roller coaster, comprising a base; a closed guide circuit; a station; a vehicle, said guide circuit including a section located in said station area, and a spiral ascent section conjugated with said section located in said station area, said spiral ascent section being formed so that said vehicle or a part of it moves through said spiral ascent section in a reverse position on its end part before a descent.

2. A roller coaster as defined in claim 1, wherein said guide circuit includes a looping section conjugated with said section located in said station area.

3. A roller coaster as defined in claim 1, wherein said guide circuit between said spiral ascent section and said looping section further includes a descent section, a second ascent section, a second descent section, a further looping section with an ascent section and a spiral descent section, wherein said first mentioned looping section is located under upper parts of said descent section and said second ascent section.

4. A roller coaster as defined in claim 3, wherein a conjugating section of said second ascent section and said second descent section and a part of said first mentioned looping section are connected with cross pieces which have ends connected with two supports, said first mentioned looping section having an initial part and a final part connected with one of said cross pieces.

5. A roller coaster as defined in claim 4, wherein said cross pieces having middle parts which are connected with said looping sections and are also connected with a vertical support.

6. A roller coaster defined in claim 1, wherein said spiral ascent section has a middle part which is inclined from a vertical line.

7. A roller coaster as defined in claim 1, wherein said section located in said station area is formed so that it is displaceable along a vertical line.

8. A roller coaster as defined in claim 1, wherein said vehicle is formed so that it cooperates with said guide circuit in a manner selected from the group consisting of being supported on said guide circuit and being suspended on said guide circuit.

* * * * *